United States Patent [19]

Morton

[11] Patent Number: 4,556,340

[45] Date of Patent: Dec. 3, 1985

[54] METHOD AND APPARATUS FOR PRODUCTION OF SUBSEA HYDROCARBONS USING A FLOATING VESSEL

[75] Inventor: Arthur W. Morton, Houston, Tex.

[73] Assignee: Conoco Inc., Ponca City, Okla.

[21] Appl. No.: 523,315

[22] Filed: Aug. 15, 1983

[51] Int. Cl.[4] ..... E21B 17/01

[52] U.S. Cl. ..... 405/195; 166/350; 166/359; 405/169

[58] Field of Search ..... 405/195, 203–208, 405/224, 225, 226; 166/350, 359, 367; 285/114

[56] References Cited

U.S. PATENT DOCUMENTS

| | | | |
|---|---|---|---|
| 396,773 | 1/1889 | Smith | 285/114 |
| 2,853,262 | 9/1958 | Reimann | 285/114 X |
| 3,517,110 | 6/1970 | Morgan | 166/350 X |
| 3,538,238 | 11/1970 | Delacor et al. | 166/359 X |
| 3,983,706 | 10/1976 | Kalinowski | 166/367 X |
| 4,176,986 | 12/1979 | Taft et al. | 166/350 X |
| 4,363,567 | 12/1982 | van der Graaf | 166/367 X |
| 4,383,554 | 5/1983 | Merriman | 166/350 X |

OTHER PUBLICATIONS

"Buoy Mooring Forum SPM Hose System Design Commentary (Current Practice)".

*Primary Examiner*—Dennis L. Taylor
*Attorney, Agent, or Firm*—Stephen A. Littlefield

[57] ABSTRACT

Production from a subsea wellhead to a floating production facility may be realized with the use of a substantially neutrally buoyant flexible production riser which includes biasing means for shaping the riser in an oriented broad arc. The broad arc configuration permits the use of wireline well service tools through the riser system.

2 Claims, 5 Drawing Figures

METHOD AND APPARATUS FOR PRODUCTION OF SUBSEA HYDROCARBONS USING A FLOATING VESSEL

This invention relates to the art of hydrocarbon production from offshore, subsea formations and, more particularly, to an apparatus and method for realizing early production through the use of a floating vessel in advance of or in lieu of a bottom-founded platform structure.

BACKGROUND OF THE INVENTION

In the production of hydrocarbon fluids from subsea formations, it is often desirable from an economic standpoint to achieve early production of the hydrocarbon fluids prior to the installation of a more permanent, bottom-founded structure. Additionally, formations are often discovered which are marginally economic for the installation of a high cost, permanent production structure. For these reasons, production of the subsea hydrocarbon fluids to a floating production facility is often considered.

Floating hydrocarbon production facilities have found application for development of marginally economic discoveries, early production, extended reservoir testing, and flexibility in offshore development. Additional advantages of a floating facility over a conventional platform include early production and cash flow from one to two years ahead of a fixed platform as well as lower initial cost. Further, upon depletion of the produced field, a floating facility may be easily moved to another field for additional production work.

In deeper water (300 feet or more), the use of bottom-founded steel or concrete structures for oil well drilling and production operations becomes quite expensive due to the high cost of fabrication and installation of such large structures. In deep water, construction and installation times are extended which delays the onset of revenue from production. Moreover, oil reserves in place must be much larger in deep water in order to justify the higher development costs. The number of "marginal" subsea hydrocarbon fields grows rapidly with increasing water depth.

Floating production systems employing ship-shaped vessels, barges or semi-submersible-type hulls have been used to obtain "early production" prior to construction of permanent, bottom-founded structures. Floating production systems have been installed to produce "marginal" subsea reservoirs with only a few wells, reservoirs to small to develop with bottom founded structures.

Existing floating production systems utilize various types of production risers to convey produced fluids from the sea floor manifold or subsea wellhead to the surface. Because the risers are commonly steel pipe and are fixed at their lower end, they must be supported at their upper ends with automatic heave compensating equipment so that vertical vessel motions (heave) produced by wave action or tidal effects are not imposed on the production risers. Additionally, because of the floating vessel cannot be held in an exact surface position by the mooring system, the lower end of a production riser must be equipped with a flexible connection to prevent the development of bending loads in the riser or subsea wellhead as a consequence of vessel excursions away from a surface position directly above the lower connection of the production riser.

Flexible piping such as disclosed in U.S. Pat. Nos. 3,499,668, 3,559,693 and 4,213,485 have been used in various offshore installations for transport of hydrocarbon fluids. Flexible piping has been laid on the sea floor as flowlines to connect individual subsea wells to a centrally located sea floor manifold. Further, flexible piping has also been used to convey produced fluids from the sea floor to the surface. Commonly, these flexible risers have been configured into a catenary pattern. To obtain such a configuration, installations have been made in which the flexible pipe has a single buoy or a lay on the sea floor intermediate the sea floor connection and the surface facility such as a ship, semi-submersible, or buoy. Such configurations do not allow a direct "wireline" reentry into the production strings for well servicing. Typical of such an installation is that described in U.S. Pat. No. 4,266,886.

In the afore-mentioned U.S. Pat. No. 4,266,886, heave compensation is provided for in a flexible production riser without the use of mechanical heave compensators by the provision of a catenary loop in the flexible riser. It is also known to position floatation means at the wellhead side of the catenary loop in order to maintain the catenary flexible riser out of contact with the sea floor. Alternatively, it is known to lay a substantial length of flexible riser directly on the sea floor which is picked up off the sea floor in compensating for vertical heave of the floating facility to which it is connected. None of these apparatus allow for the use of wireline well service tools since such tools cannot pass by gravity through a loop or horizontal lay in the riser.

It is also common to provide various floation means on subsea production risers principally for the purpose of reducing riser weight. U.S. Pat. Nos. 3,605,413, 3,768,842, 3,952,526 and 3,981,357 are exemplary of this type of light weight, metallic riser incorporating floation. Floation has also been used with flexible production risers as illustrated in U.S. Pat. Nos. 3,517,110 and 3,911,688.

SUMMARY OF THE INVENTION

The present invention provides a means and method for connecting a floating production vessel with a subsea well utilizing a flexible riser and permitting the use of wireline service tools with direct entry to the well through the riser.

In accordance with the invention, a system for the production of hydrocarbon fluids from a subsea well extending into a subsea formation comprises at least one sea floor wellhead having a vertical riser connection. A moored floating production vessel such as a ship, barge or semi-submersible is located at the surface of the body of water. At least one flexible production riser extends between each wellhead riser connection and the floating production vessel. In accordance with the invention, the flexible production riser includes biasing means for shaping the riser in an oriented, broad arc which permits the passage of gravity-motivated wireline well service tools between the floating production vessel and the well.

Further in accordance with the invention, a plurality of production risers are arrayed so that together, their shaping in oriented, broad arcs forms a "Chinese lantern" configuration between the wellheads and the floating production vessel.

Still further in accordance with the invention, a method of producing hydrocarbon fluids from a subsea well comprises the steps of providing a wellhead on the sea floor, providing a moored, floating production vessel on the water surface and providing at least one flexible production riser including biasing means shaping the riser in an oriented, broad arc and connecting the wellhead in fluid communication with the production vessel with the bending-biased flexible production riser.

It is therefore an object of this invention to provide a means and method for producing hydrocarbons from a subsea formation to a floating production facility which utilizes a riser system which avoids the need for motion compensating apparatus on the floating production vessel.

It is a further object of this invention to provide a means and method for producing hydrocarbon fluids from a plurality of subsea wells utilizing a plurality of flexible production risers which avoid entanglement as they extend between a plurality of wellheads located on the sea floor and a moored, floating production vessel.

It is yet another object of this invention to provide a flexible riser system which assumes a configuration that permits the passage of wireline well service tools through the length of the riser between the floating vessel and a subsea wellhead.

BRIEF DESCRIPTION OF THE DRAWINGS

These and other objects of the invention are accomplished through the manner and form of the present invention to be described hereinafter in the more limited aspects of a preferred embodiment thereof and as illustrated in the accompanying drawing forming a part of this specification and in which.

DETAILED DESCRIPTION OF THE PREFFERED EMBODIMENTS AND THE DRAWINGS

Figure 1:
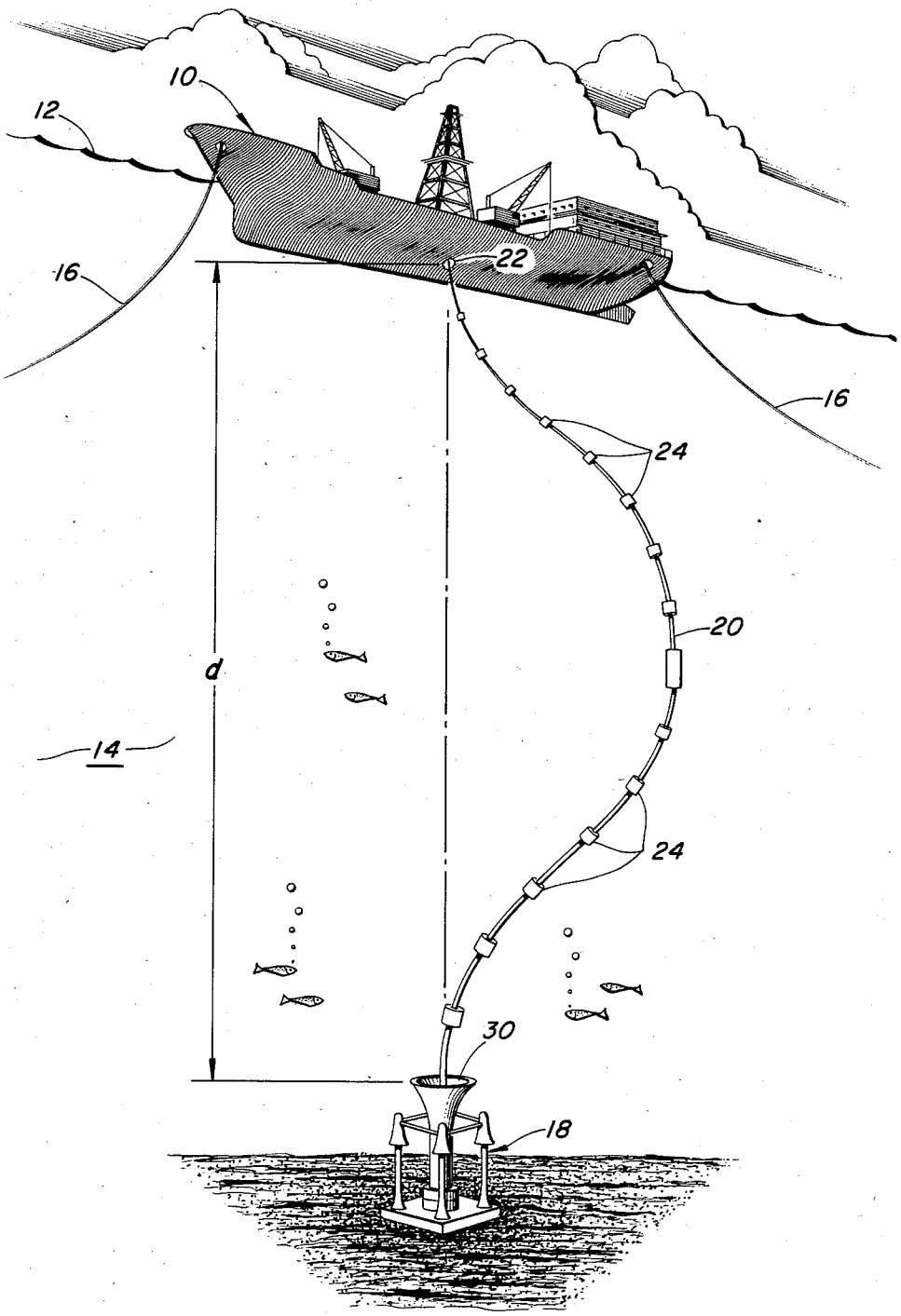
FIG. 1 is a schematic, elevational view of an offshore production installation incorporating a single flexible production riser in accordance with the apparatus and method of this invention.

Referring now to the drawings wherein the showings are for the purposes of illustrating a preferred embodiment of the invention only and not for the purposes of limiting same, FIG. 1 shows a floating production facility 10 located on the surface 12 of a body of water 14. It will be understood that while a ship-shaped vessel is shown such as an oil tanker converted to an oil production facility, other floating production vessels such as barges, semi-submersible hulls and the like may be employed. The floating production vessel 10 is moored in a limited area by a plurality of catenary mooring lines 16 which are common in the art. The mooring lines extend to anchoring means (not shown) on the bottom of the body of water 14.

Also located on the bottom of the body of water 14, in a position generally directly below the floating production vessel 10 is a wellhead assembly 18. The wellhead assembly 18 includes all of the necessary valving and equipment for completion and tieback of a well extending to a subsea hydrocarbon containing formation.

In accordance with the invention, a flexible production riser 20 extends from the wellhead 18 upwardly to a connector assembly 22 located on the floating production vessel 10. Although the connector assembly 22 is shown disposed in a moon pool in the floating production vessel 10, it will be understood that other locations and arrangements for connection of the flexible riser 20 to the floating production vessel 10 may be employed. The flexible production riser 20 is of a length greater than the vertical distance (d) between the vessel 10 and the wellhead 18. In accordance with the invention, the flexible production riser 20 assumes an oriented arc form having a relatively large radius of curvature between the wellhead 18 and the vessel 10. In the preferred embodiment shown in FIG. 1, the oriented arc shape of the production riser is created by the positioning of a plurality of floatation means 24 positioned along the length of the flexible production riser 20. In its preferred form, the flexible production riser 20 with its associated floatation means 24 has a neutral or, preferably, slightly negative buoyancy in water.

The wellhead assembly 18 preferably includes a funnel-shaped body 30 at its upward end. The funnel-shaped body 30 acts as a means for limiting the bending which is permitted in the flexible riser 20 so that the riser does not bend beyond tolerable limits for both its structure and for permitting passage of well service tools therethrough. Additional bend limiting means may be provided for the flexible riser 20 at either or both the wellhead 18 and the connector assembly 22 on the floating production vessel 10. Such end fittings as are common in the art which include bending string relief means, helical stiffener members and the like typical of common collet connectors are preferably employed in connecting the ends of the flexible riser 22 there associated and fittings.

It can be seen that despite a relatively rigid connection of the flexible production riser 20 to the floating production vessel 10, vessel motions such as heave (up and down), surge (forward and back) and sway (side to side) or any combination of these motions is fully compensated for by the broad arc loop in the flexible production riser 20 without the necessity of motion compensation apparatus such as riser tensioner being provided on the floating production vessel 10. More importantly, the broad bends in the flexible production riser 10 permit the user of gravity-motivated wireline well service tools to be run from the vessel 10 through the riser 20 and into the subsea well through the wellhead 18 without interference.

Figure 2:
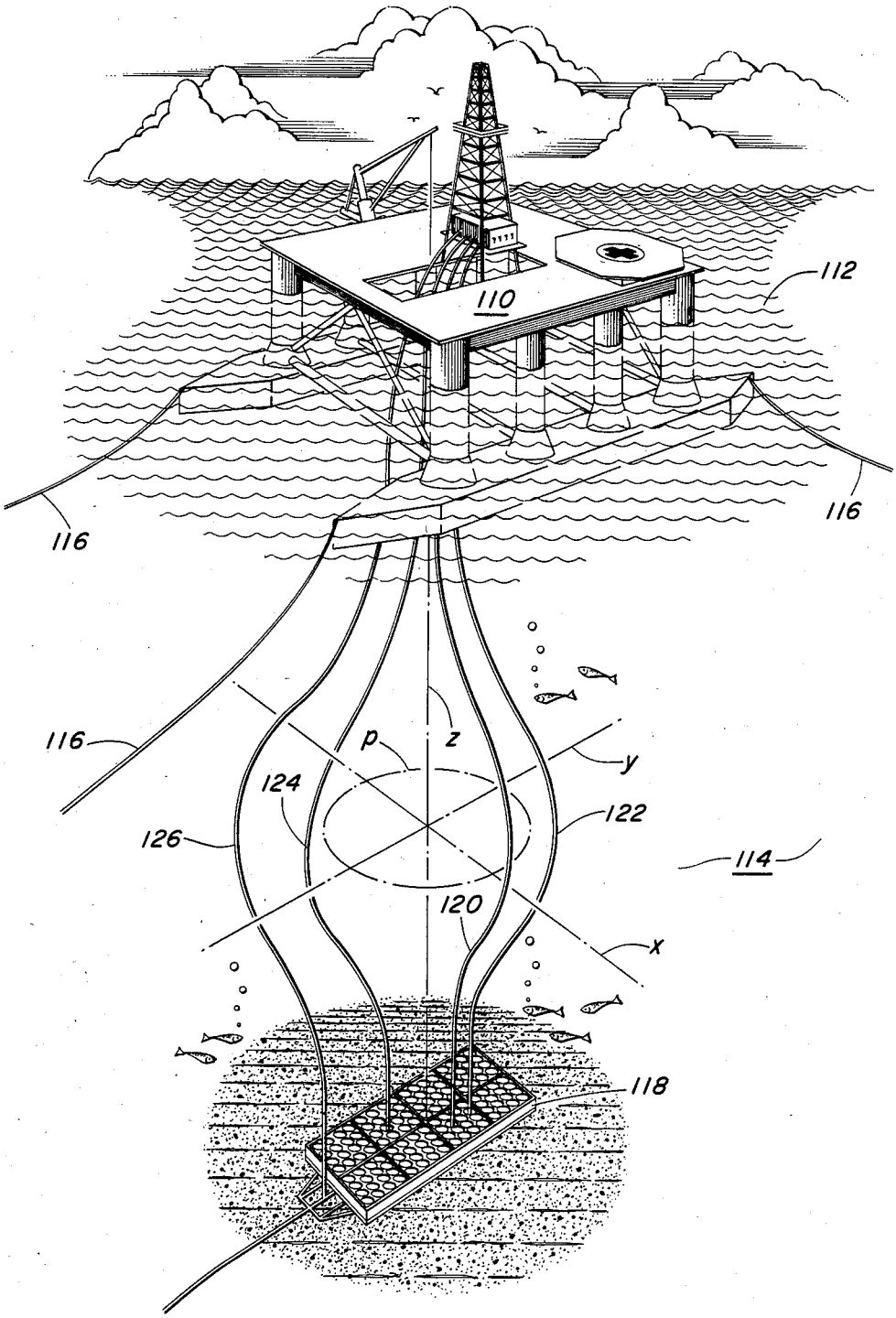
FIG. 2 is a schematic elevational view of a similar offshore production facility incorporating a plurality of flexible production risers in accordance with the apparatus and method of this invention.

In FIG. 2 is shown a production system for producing hydrocarbons from a plurality of subsea wells. A floating production vessel 110 is moored on the surface 112 of a body of water 114 by an array of mooring lines 116 which maintain the floating production vessel 110 in a localized area in accordance with procedures known in the art. As is known, the mooring lines 116 extend to anchoring means located on the bottom of the body of water 114. Although the figure shows the floating production vessel 110 to be a semi-submersible hull adapted for production of hydrocarbons, it will be understood that other floating production vessels such as converted oil tanks and barges may be substituted for the semi-submersible shown.

A subsea well template 118 is located generally directly below the floating production vessel 110 at the bottom of the body of water 114. As is common, the subsea well template 118 includes a plurality of wells having common completion and tieback apparatus associated therewith. The wells of the subsea template 118 extend to various portions of subsea hydrocarbon containing formations.

The desired "Chinese lantern" configuration of the buoyant flexible production risers 120, 122, 124 is clearly shown in FIG. 2. A horizontal plane p is defined by axes x and y and is intersected perpendicularly by axis z. In accordance with the invention, the oriented, broad shaped arcs of the buoyant flexible riser 120 and 124 intersect the plane p along the x axis at points spaced oppositely laterally outwardly of the vertical axis z. Similarly, the flexible production riser 122 intersects the plane p along the y axis outwardly of the vertical axis z. Also shown in the Figure is a sales riser 126 which is structurally similar to the flexible production risers 120, 122, 124 and intersects the plane p along the y axis laterally opposite the flexible production riser 122 at a point laterally spaced from the vertical axis z. The flexible sales riser 126 is used to offload produced fluids to a sales export line 128 through a manifold 130 attached to the subsea well template 118. All of the buoyant flexible risers 120 through 126 incorporate means for biasing each of the risers into a shape of an oriented, broad arc which would permit the passage of wireline well service tools directly into the well through the risers. It will be understood that while only four risers are shown in defining the preferred "Chinese lantern" configuration, it will be understood that such illustration is primarily for the purpose of avoiding complication in the illustration of the invention and that many more buoyant flexible risers may be employed in a generally radially disposed array around the central vertical axis z. As with the previously discussed embodiment, it can be clearly seen that no motion compensation need be provided on the deck of the floating production facility 110 and further that direct, wireline access to the subsea wells would not be inhibited by the use of the buoyant flexible production risers 120–124.

It will be further understood with respect to FIG. 2 that while no buoyancy modules are shown attached to any of the buoyant flexible risers 120–125, it is contemplated, and in fact, required that buoyancy be provided to the risers so that they have substantially neutral buoyancy in water.

Figure 3:
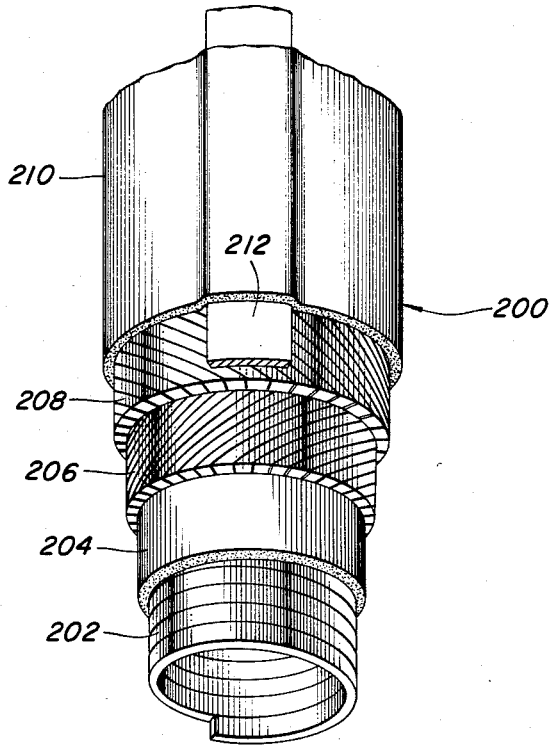
FIG. 3 is a fragmented elevational view of one form of flexible production riser used in accordance with the apparatus and method of this invention.

FIG. 3 illustrates a preferred construction for the buoyant flexible risers 10, 110 as shown in the previous figures. The flexible pipe 200 comprises a spiral wound inner carcass 202 which is preferably made of stainless steel. The carcass allows for bending of the pipe 200 by relative movement of the convolutions in an articulating motion. Therefore, there is no "ovalization" of the inner diameter of the pipe and the full inside diameter of the pipe is retained regardless of bending radius of curvature or the imposition of external hydrostatic load.

Around the exterior of the inner carcass is a thermoplastic sheath 204 which is provided primarily for the purpose of maintaining fluid-tight integrity of the pipe. The thermoplastic sheath 204 is meant to be the pressure containing member of the pipe 200 while the inner carcass 202 provides flexibility, collapse protection and protection from abrasion by flowing well fluids as well as wireline tools run into the well. A pair of flexible steel armor layers 206, 208 are oppositely helically wound around the exterior of the sheath 204 to keep the inner thermoplastic sheath 204 from extruding when pressure and heat are applied from the inside of the pipe 200. The armor layers 206, 208 also provide impact protection for the inner thermoplastic sheath 204.

It is common practice to construct flexible pipe with four steel armor layers. The additional two armor layers are used as tension members and generally have a much longer helix angle. Such a construction would allow a pipe to be pulled at a greater tension than the buoyant flexible pipe contemplated in accordance with the present invention. The elimination of an additional two tension steel armor layers in the construction of a flexible pipe reduces the weight of the pipe and minimizes the number and size of buoyancy modules required to make the pipe substantially neutrally buoyant in water for application as a buoyant flexible riser as contemplated in the present invention.

An outer flexible thermoplastic sheath 210 is provided for the purposes of corrosion and abrasion protection of the underlying layers.

In accordance with one preferred form of construction for a bending biased flexible production riser, the flexible pipe 200 incorporates a strip of material 212 along one side of the construction. The strip 212 may be any material having large axial stiffness in tension (large modulus of elasticity) and low axial stiffness in compression such as a steel or fiberglass strip bonded between the outer thermoplastic sheath 210 and the outer surface of the outer steel armor layer 208. For the purposes of this specification, the term "biased bending" is defined as the tendency of a riser to bend in one particular direction rather than in any other direction. Plus, by rigidly fixing the end connections of a length of flexible pipe 200, any shortening of the distance between the two connecting points which would result in a slackening of the flexible pipe 200, the bending biasing means such as the strip 212 associated with the flexible pipe 200 would cause the flexible pipe 200 to preferentially bend in only one direction. As has been seen in conjunction with FIG. 2, the flexible risers are oriented and biased so that the preferential bending is generally radially outwardly away from a vertical axis between the end connecting point at the subsea template 118 and the floating production vessel 110.

Figure 4:
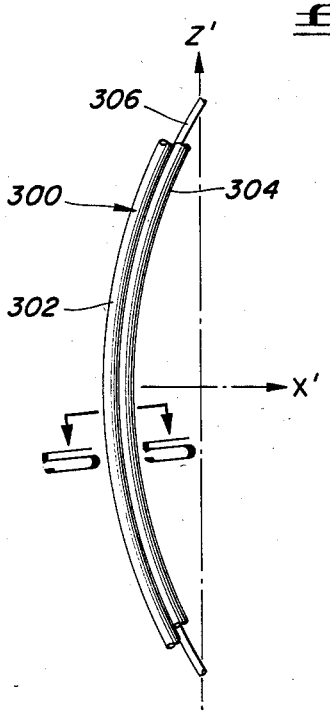
FIG. 4 is a schematic, elevational view of a form of flexible riser bundle in accordance with another embodiment of this invention.
Figure 5:
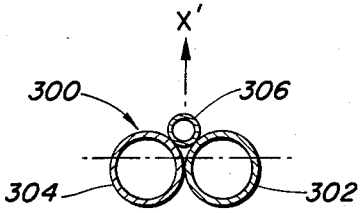
FIG. 5 is a cross-sectional view of the riser bundle shown in FIG. 4 taken along line 5—5 thereof.

FIGS. 4 and 5 illustrate yet another means for biasing a buoyant flexible riser in a preferred bending direction. Up to this point, the invention has been described with respect to single tubular flexible risers. In actual use, it is more common to bundle a plurality of such flexible risers and the manner in which the bundles are assembled can provide, in and of itself, a means for biasing the bending of the flexible bundle in a preferred direction. Thus, FIGS. 4 and 5 show a riser bundle 300 comprised of a pair of large diameter flexible pipes 302, 304 of the type described with respect to FIG. 3 and a smaller diameter bundle 306. The third pipe 306 is preferably a control bundle with no armor or carcass and, as such, its stiffness in tension is much larger than in a compression. In other words, the control bundle acts like a cable with a relatively large axial stiffness in tension but very little or almost zero in compression. Thus, the flexible pipe bundle 300 will deflect in such a way as to keep the control bundle 306 in the compression side of the bend. Thus, the pipe bundle 300 including the control bundle 306 is biased to bend preferentially away from the z' axis along the x axis as shown in FIG. 4. This form of biasing means may be incorporated in any riser bundle and along with buoyancy modules, may be used in a manner similar to the buoyant flexible risers discussed in conjunction with FIGS. 1 and 2.

While the invention has been described in the more limited aspects of a preferred embodiment thereof, other embodiments have been suggested and still others will occur to those skilled in the art upon the reading and understanding of the foregoing specification. It is intended that all such embodiments be included within the scope of this invention as limited only by the appended claims.

Having thus described my invention, I claim:

1. In a system for the production of hydrocarbon fluids from a subsea well including at least one well head having a riser connection, a moored, floating production vessel located at the surface of the body of water, and at least one flexible production riser extending between said well head riser connection and said vessel, said flexible riser being substantially neutrally buoyant and further including biasing means on said riser for shaping said riser in an oriented, broad arc, said biasing means including a control bundle disposed on one side of said riser bundle, whereby the passage of gravity-motivated wireline well service tools between said vessel and said well is permitted.

2. The improvement as set forth in claim 1 including a plurality of said risers, said risers disposed in an array so that said oriented, broad arc of each riser is oriented radially outwardly of a vertical line extending from said sea flood to said floating vessel, said plurality of risers forming a "Chinese lantern" shape.

* * * * *